US007631952B2

(12) United States Patent
Chiang

(10) Patent No.: US 7,631,952 B2
(45) Date of Patent: Dec. 15, 2009

(54) COLLAPSIBLE COMBINATION CABINET

(76) Inventor: Chien-I Chiang, 38, Pao Chung 3 St., Hou-Hu Li, Chiayi (TW)

( * ) Notice: Subject to any disclaimer, the term of this patent is extended or adjusted under 35 U.S.C. 154(b) by 302 days.

(21) Appl. No.: 11/714,541

(22) Filed: Mar. 6, 2007

(65) Prior Publication Data

US 2008/0218041 A1 Sep. 11, 2008

(51) Int. Cl.
*A47B 43/00* (2006.01)

(52) U.S. Cl. ..... 312/258; 312/348.1

(58) Field of Classification Search ..... 312/258, 312/262, 257.1, 263, 265.5, 265.6, 330.1, 312/348.1–348.4; 108/115
See application file for complete search history.

(56) References Cited

U.S. PATENT DOCUMENTS

| | | | | | |
|---|---|---|---|---|---|
| 122,179 | A * | 12/1871 | Lawrence | 312/258 |
| 242,355 | A * | 5/1881 | Nicholas | 217/16 |
| 298,821 | A * | 5/1884 | Brolaski | 312/264 |
| 321,586 | A * | 7/1885 | Deming | 312/262 |
| 364,796 | A * | 6/1887 | Brolaski | 312/258 |
| 1,188,974 | A * | 6/1916 | Montgomery | 312/258 |
| 2,244,679 | A * | 6/1941 | Derman | 312/260 |
| 2,249,344 | A * | 7/1941 | Blechman | 312/296 |
| 2,778,034 | A * | 1/1957 | Smith | 5/2.1 |
| 2,808,305 | A * | 10/1957 | Jackson | 312/140.2 |
| 3,240,862 | A * | 3/1966 | Merkl et al. | 174/371 |
| 3,583,781 | A * | 6/1971 | Yamawaki et al. | 312/258 |
| 4,232,921 | A * | 11/1980 | Peele | 312/350 |
| 4,482,195 | A * | 11/1984 | Chapin | 312/210 |
| 5,954,412 | A * | 9/1999 | Rutherford et al. | 312/258 |
| 6,722,750 | B2 * | 4/2004 | Chan | 312/258 |
| 6,976,743 | B1 * | 12/2005 | Hwang | 312/258 |
| 2003/0155847 | A1 * | 8/2003 | Henkel | 312/257.1 |
| 2003/0201698 | A1 * | 10/2003 | Liang et al. | 312/262 |
| 2005/0067926 | A1 * | 3/2005 | Chiang | 312/258 |
| 2008/0258591 | A1 * | 10/2008 | Chiang | 312/317.1 |

* cited by examiner

*Primary Examiner*—Janet M Wilkens
(74) *Attorney, Agent, or Firm*—Alan Kamrath; Kamrath & Associates PA

(57) ABSTRACT

A combination cabinet includes a main body, a plurality of bottom boards, a plurality of back boards, a plurality of resting boards, a top board, and a connecting seat. Thus, the main body is folded to have a flat shape and all parts of the combination cabinet are folded and detached before assembly, so that the combination cabinet has a smaller volume, thereby facilitating packaging, storage and transportation of the combination cabinet. In addition, the combination cabinet is assembled and disassembled easily and quickly without needing aid of any hand tool, thereby facilitating a user assembling and disassembling the combination cabinet.

19 Claims, 8 Drawing Sheets

COLLAPSIBLE COMBINATION CABINET

BACKGROUND OF THE INVENTION

1. Field of the Invention

The present invention relates to a cabinet and, more particularly, to a combination cabinet.

2. Description of the Related Art

A conventional cabinet comprises a cabinet body, and a plurality of drawers movably mounted in the cabinet body to receive articles. However, the cabinet has a fixed construction and cannot be detached so that the cabinet occupies a larger volume, thereby greatly causing inconvenience to a user in packaging, storage and transportation of the cabinet. In addition, the cabinet cannot be assembled and disassembled easily and quickly, thereby increasing the costs of fabrication. Further, the cabinet is assembled and disassembled by aid of a hand tool, such as a screwdriver, thereby causing inconvenience when assembling and disassembling the cabinet.

BRIEF SUMMARY OF THE INVENTION

The primary objective of the present invention is to provide a collapsible combination cabinet.

Another objective of the present invention is to provide a combination cabinet, wherein the main body is folded to have a flat shape and all parts of the combination cabinet are folded and detached before assembly, so that the combination cabinet has a smaller volume, thereby facilitating packaging, storage and transportation of the combination cabinet.

A further objective of the present invention is to provide a combination cabinet, wherein the combination cabinet is assembled and disassembled easily and quickly without needing aid of any hand tool, thereby facilitating a user assembling and disassembling the combination cabinet.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
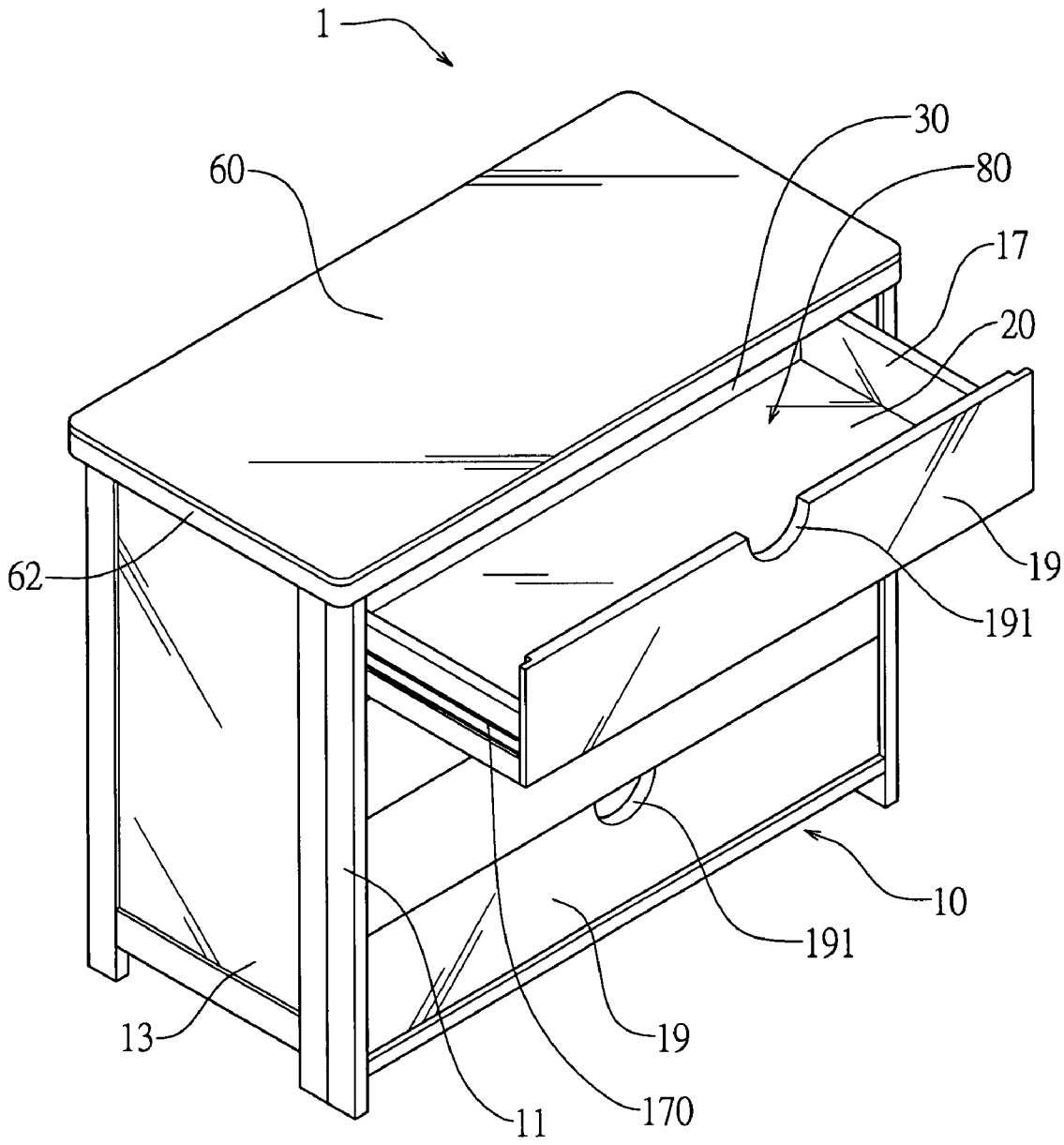
FIG. 1 is a perspective view of a combination cabinet in accordance with the preferred embodiment of the present invention.
Figure 2:
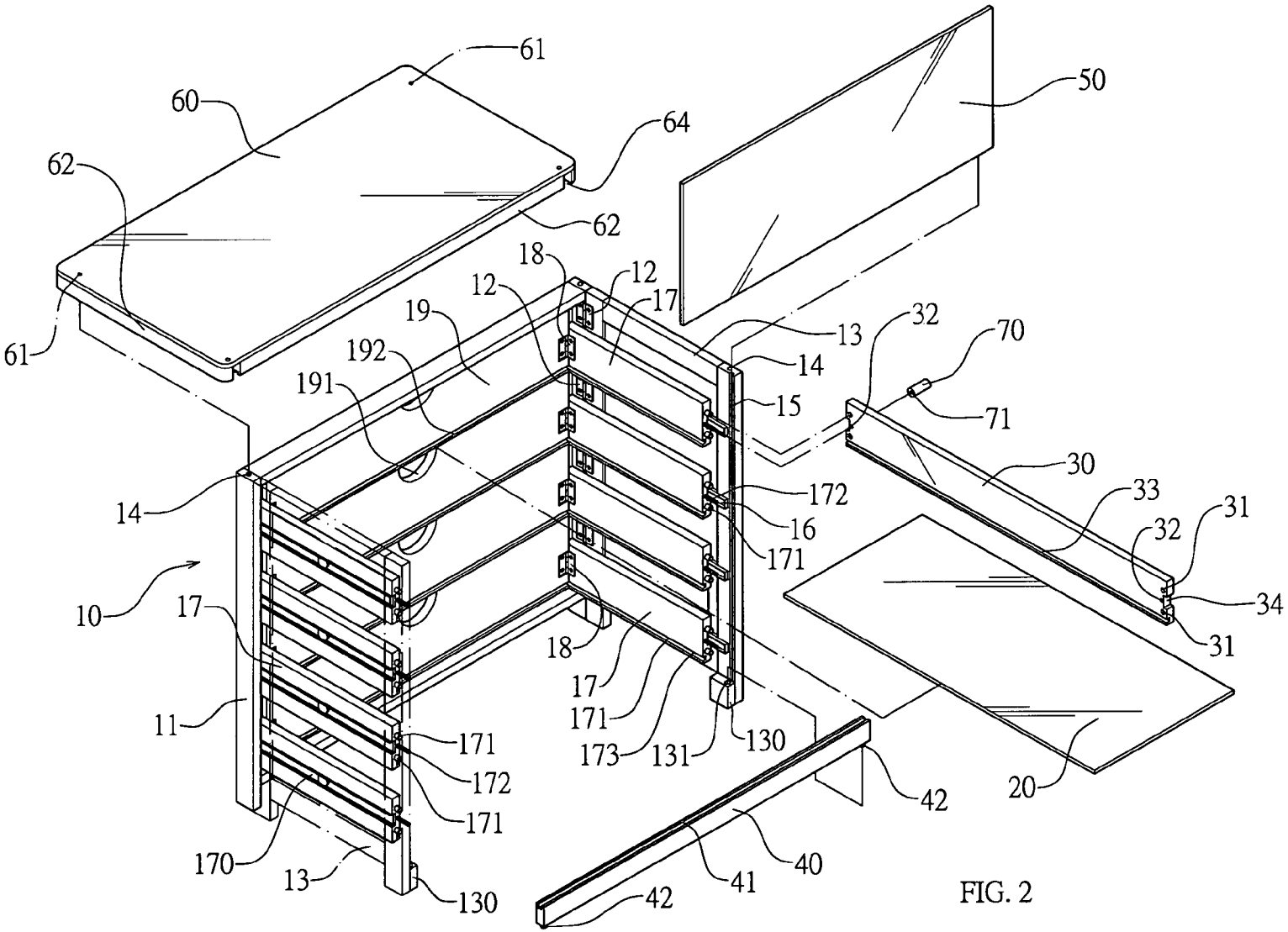
FIG. 2 is an exploded perspective view of the combination cabinet as shown in FIG. 1.

Referring to the drawings and initially to FIGS. 1 and 2, a collapsible combination cabinet 1 in accordance with the preferred embodiment of the present invention comprises a main body 10, a plurality of bottom boards 20, a plurality of back boards 30, a plurality of resting boards 50, a top board 60, and a connecting seat 40.

The main body 10 includes a front frame 11, two side boards 13 each having a first end pivotally mounted on one of two opposite ends of the front frame 11 and each provided with a plurality of guide rails 16, a plurality of sliding boards 17 each slidably mounted on a respective guide rail 16 of each of the side boards 13, and a plurality of juxtaposed front boards 19 each having two opposite ends each mounted on a first end of a respective sliding board 17 to move with the respective sliding board 17.

Each of the bottom boards 20 is detachably mounted between a respective front board 19 of the main body 10 and two respective sliding boards 17 of the main body 10.

Each of the back boards 30 has two opposite ends each mounted on a second end of a respective sliding board 17 of the main body 10 to move with the respective sliding board 17 of the main body 10.

Each of the resting boards 50 has two opposite ends each detachably mounted on a second end of a respective side board 13 of the main body 10.

The top board 60 is mounted on a top of the main body 10.

The connecting seat 40 is mounted on a bottom of the main body 10 and rested on a lowermost one of the resting boards 50.

Each of the side boards 13 of the main body 10 is pivotally mounted on the front frame 11 by a plurality of hinges 12. The second end of each of the side boards 13 is formed with an axially extending elongated guide channel 15 in which each of the resting boards 50 is slidable. The guide channel 15 of each of the side boards 13 has a lower end formed with a protruding support stud 130 having a limit hole 131. The sliding boards 17 of the main body 10 are located in and encompassed by the side boards 13. Each of the sliding boards 17 of the main body 10 has a side formed with an axially extending elongated slideway 170 slidable on the respective guide rail 16 of each of the side boards 13. Each of the sliding boards 17 of the main body 10 is pivotally mounted on the respective front board 19 by a hinge 18. The second end of each of the sliding boards 17 is formed with two spaced limit posts 171 and a threaded rod 172 located between the limit posts 171. Each of the sliding boards 17 of the main body 10 has a lower end formed with an axially extending elongated guide slot 173 to allow insertion of a respective bottom board 20. Each of the front boards 19 of the main body 10 has a lower end formed with an axially extending elongated limit slot 192 to allow insertion of a respective bottom board 20 and an upper end formed with an opening 191 to facilitate a user holding each of the front boards 19 of the main body 10. The main body 10 further includes a plurality of positioning ribs 14 mounted on a top of the front frame 11 and a top of each of the side boards 13.

Each of the back boards 30 is rested on a respective bottom board 20 so that each of the back boards 30, two respective sliding boards 17 of the main body 10, a respective front board 19 of the main body 10 and a respective bottom board 20 form a rectangular box 80 which is covered by the top board 60. Each of the back boards 30 has a lower end formed with an axially extending elongated retaining slot 33 to allow insertion of a respective bottom board 20. Each of the back boards 30 is mounted on the respective sliding boards 17 of the main body 10 by two fixing rods 70. Each of the two opposite ends of each of the back boards 30 is formed with two spaced limit holes 31 to allow insertion of the limit posts 171 of the respective sliding board 17 and a through hole 32 located between the limit holes 31 to allow insertion of the threaded rod 172 of the respective sliding board 17. The threaded rod 172 of each of the sliding boards 17 extends through and partially protrudes from the through hole 32 of the respective back board 30. Each of the two opposite ends of each of the back boards 30 has an end face formed with a slideway 34 slidable on the respective guide rail 16 of each of the side boards 13.

Each of the fixing rods 70 is rested on the respective back board 30 and has an inside formed with a screw hole 71 screwed onto the threaded rod 172 of the respective sliding board 17.

The resting boards 50 are located between the side boards 13 of the main body 10 and laminate each other so that the front frame 11 of the main body 10, the side boards 13 of the main body 10 and the resting boards 50 form a hollow rectangular structure to enclose the rectangular box 80.

The top board 60 is rested on an uppermost one of the resting boards 50 so that the resting boards 50 are limited between the top board 60 and the connecting seat 40. The top board 60 has a bottom formed with a plurality of positioning holes 61 to position the positioning ribs 14 of the main body 10. The top board 60 has a periphery formed with a downward extending enclosure 62 enclosed around the main body 10. The enclosure 62 of the top board 60 has two opposite ends each formed with a mounting hole 64 mounted on a respective side board 13 of the main body 10.

The connecting seat 40 is located between the side boards 13 of the main body 10 and has two opposite ends each detachably mounted on the second end of a respective side board 13 of the main body 10. The connecting seat 40 has an upper end formed with an axially extending elongated limit channel 41 to allow insertion of the lowermost one of the resting boards 50. The connecting seat 40 has a bottom rested on the support stud 130 of each of the side boards 13 and formed with two opposite limit stubs 42 each inserted into the limit hole 131 of the respective side board 13.

Figure 3:
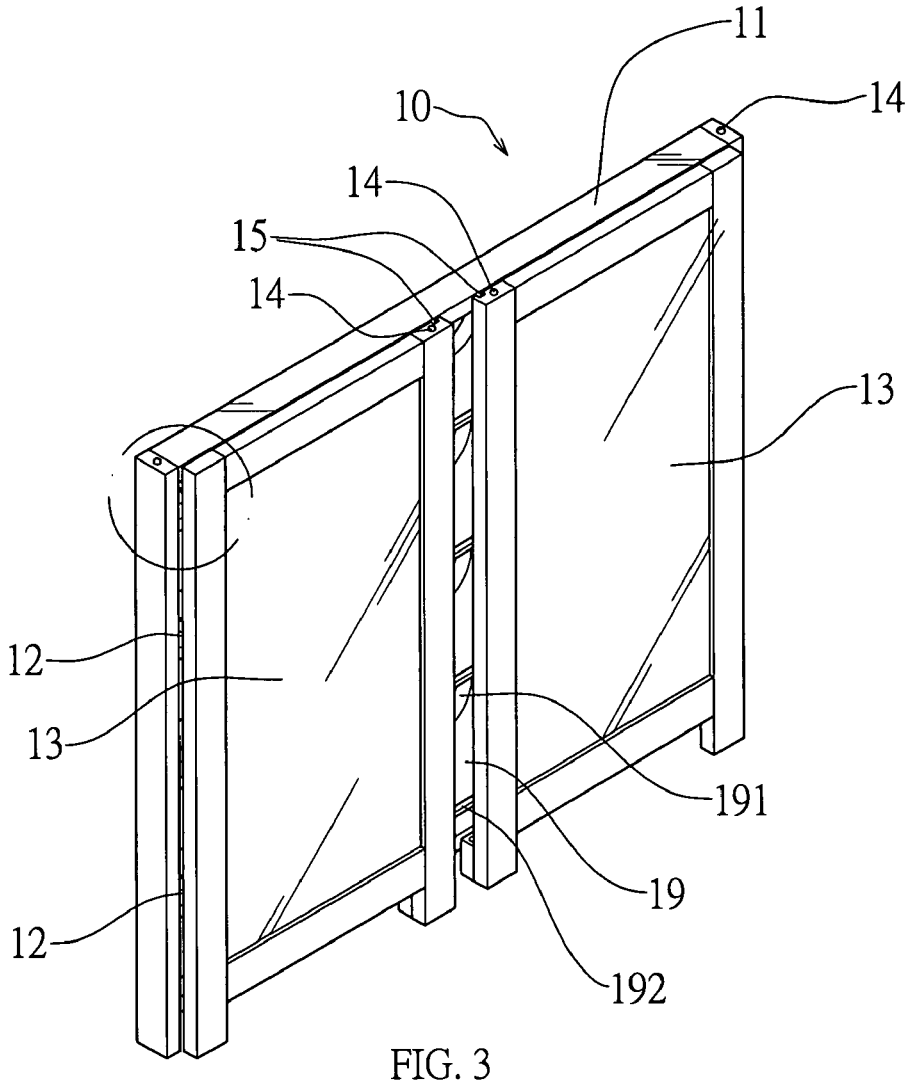
FIG. 3 is a partially perspective folded view of the combination cabinet as shown in FIG. 1.
Figure 4:
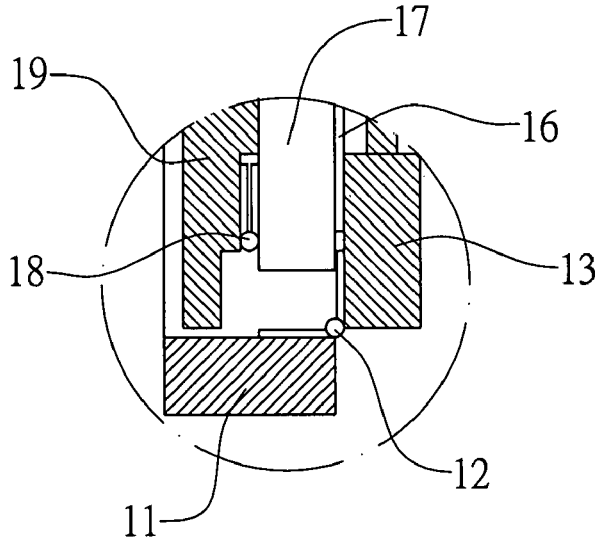
FIG. 4 is a locally enlarged cross-sectional view of the combination cabinet as shown in FIG. 3.

As shown in FIGS. 1-4, each of the sliding boards 17 of the main body 10 is pivotally mounted on the respective front board 19 by a hinge 18 so that each of the sliding boards 17 of the main body 10 is pivotable inwardly about the hinge 18 to rest on the respective front board 19, while each of the side boards 13 of the main body 10 is pivotally mounted on the front frame 11 by a plurality of hinges 12 so that each of the side boards 13 of the main body 10 is pivotable inwardly about the hinges 12 to rest on the front frame 11. Thus, the sliding boards 17 and the side boards 13 of the main body 10 are folded as shown in FIG. 3 so that the main body 10 is folded to have a flat shape when not in use.

Figure 5:
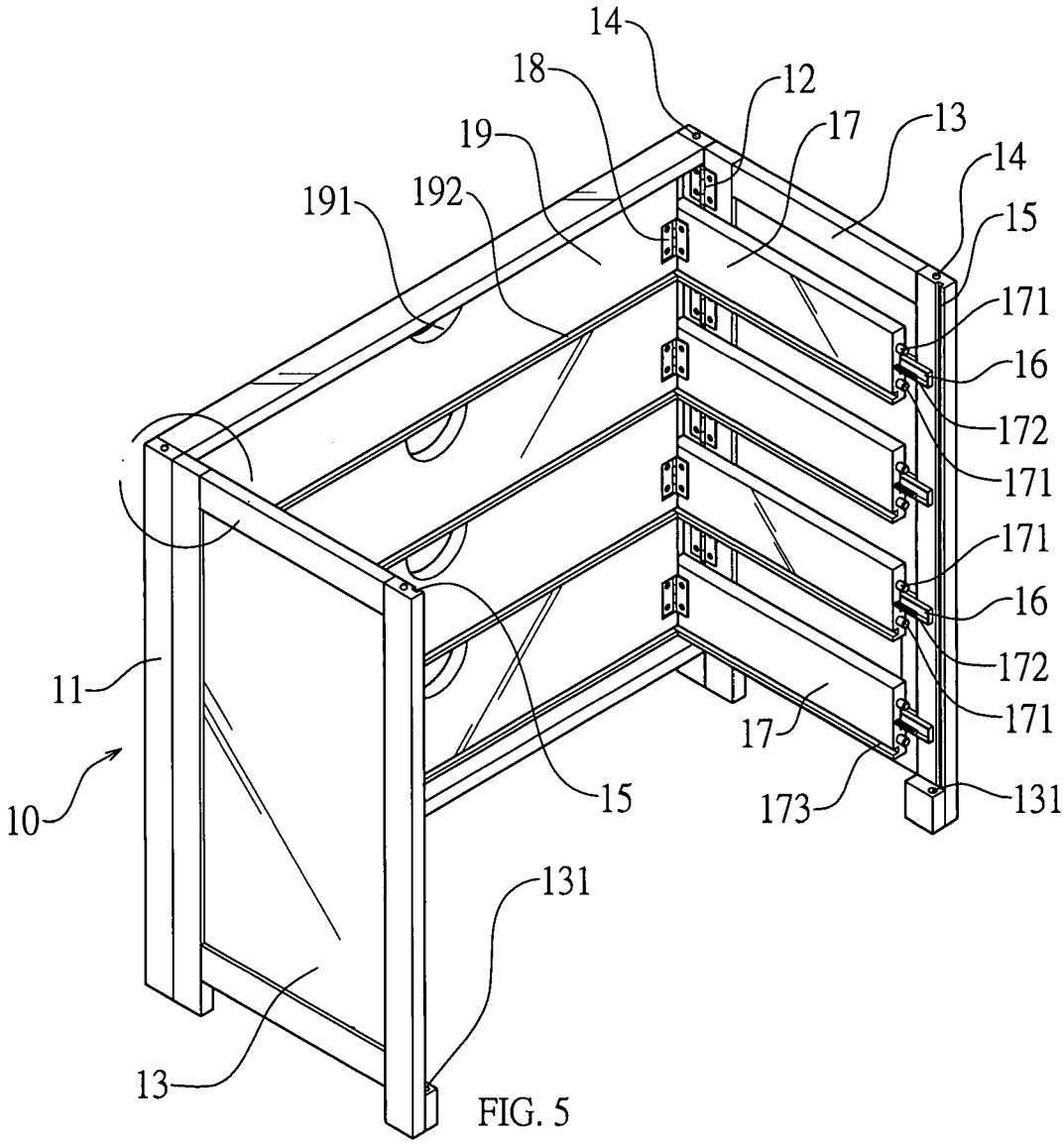
FIG. 5 is a partially perspective view of the combination cabinet as shown in FIG. 1.
Figure 6:
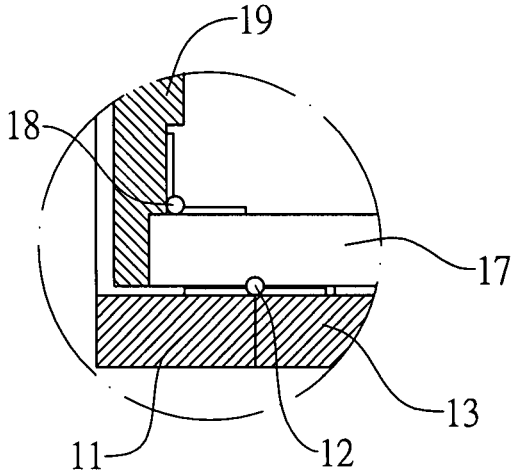
FIG. 6 is a locally enlarged cross-sectional view of the combination cabinet as shown in FIG. 5.

As shown in FIGS. 5 and 6, each of the side boards 13 of the main body 10 is pivotable outwardly about the hinges 12, and each of the sliding boards 17 of the main body 10 is pivotable outwardly about the hinge 18 so that the main body 10 is expanded completely to have a substantially U-shaped profile. At this time, each of the sliding boards 17 of the main body 10 is perpendicular to the respective front board 19, and each of the side boards 13 of the main body 10 is perpendicular to the front frame 11. In addition, each of the sliding boards 17 of the main body 10 is slidable on the respective guide rail 16 of each of the side boards 13.

Figure 7:
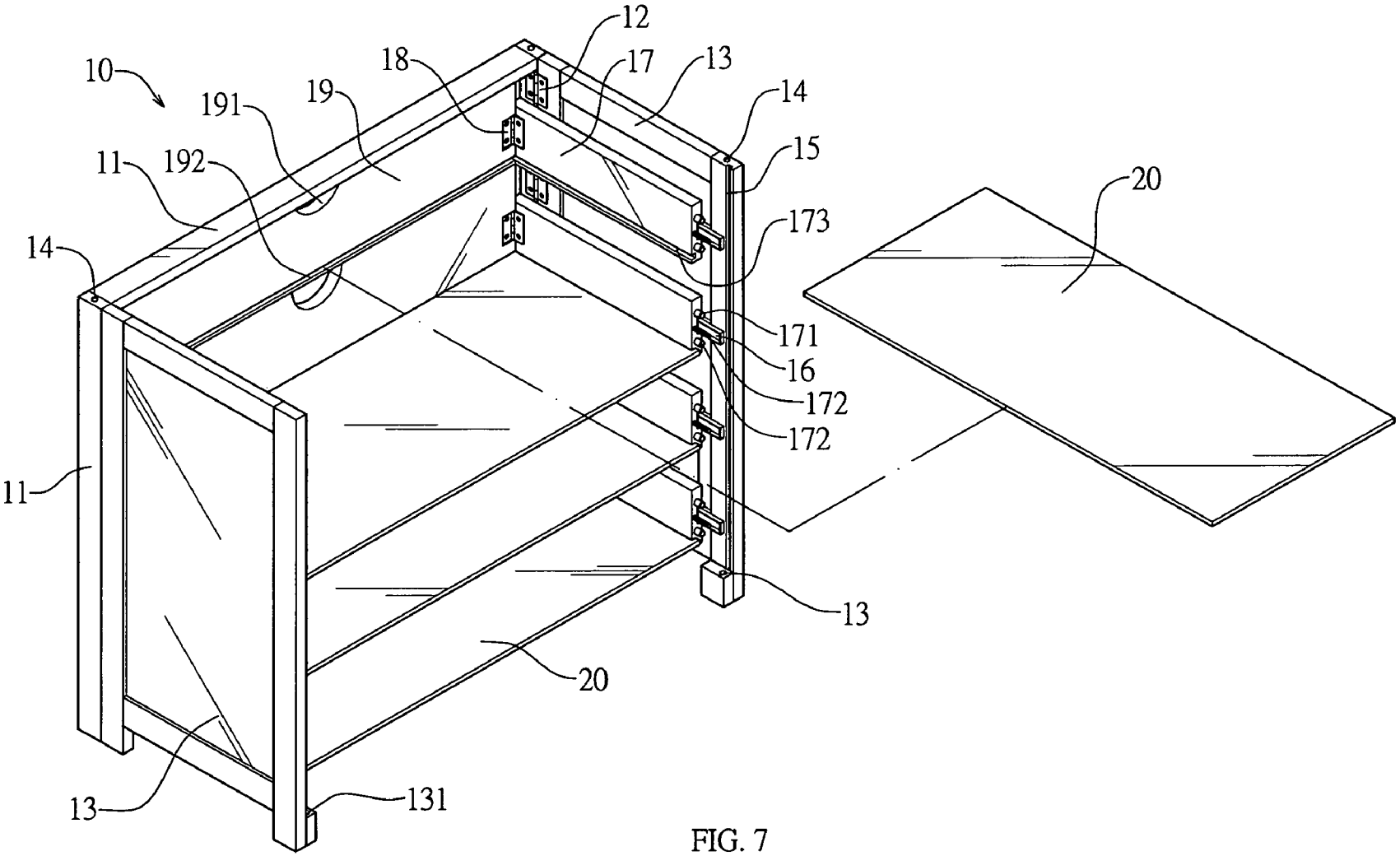
FIG. 7 is a partially perspective view of the combination cabinet as shown in FIG. 1.

As shown in FIGS. 2 and 7, each of the bottom boards 20 is in turn inserted into the guide slots 173 of the respective sliding boards 17 of the main body 10 and the limit slot 192 of the respective front board 19 of the main body 10.

Figure 8:
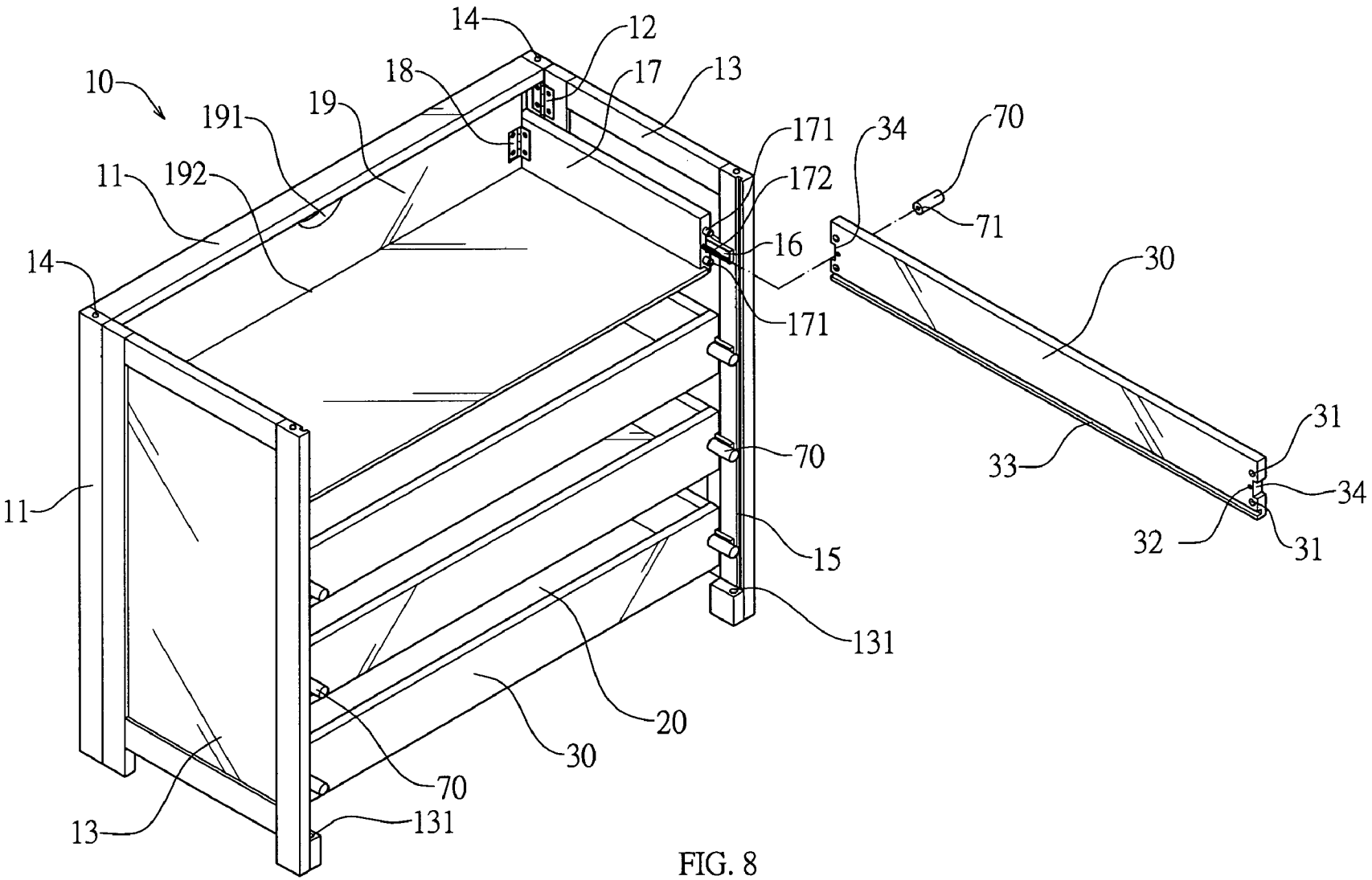
FIG. 8 is a partially perspective view of the combination cabinet as shown in FIG. 1.

As shown in FIGS. 2 and 8, when each of the back boards 30 is mounted on the respective sliding boards 17 of the main body 10, the threaded rod 172 of each of the sliding boards 17 extends through and partially protrudes from the through hole 32 of the respective back board 30, and the limit posts 171 are inserted into the limit holes 31 of the respective back board 30. At this time, each of the bottom boards 20 is inserted into the retaining slot 33 of the respective back board 30. Then, each of the fixing rods 70 is rested on the respective back board 30, and the screw hole 71 of each of the fixing rods 70 is screwed onto the threaded rod 172 of the respective sliding board 17, so that each of the back boards 30, the respective bottom board 20 and the respective sliding boards 17 are combined together closely as shown in FIG. 9.

Figure 9:
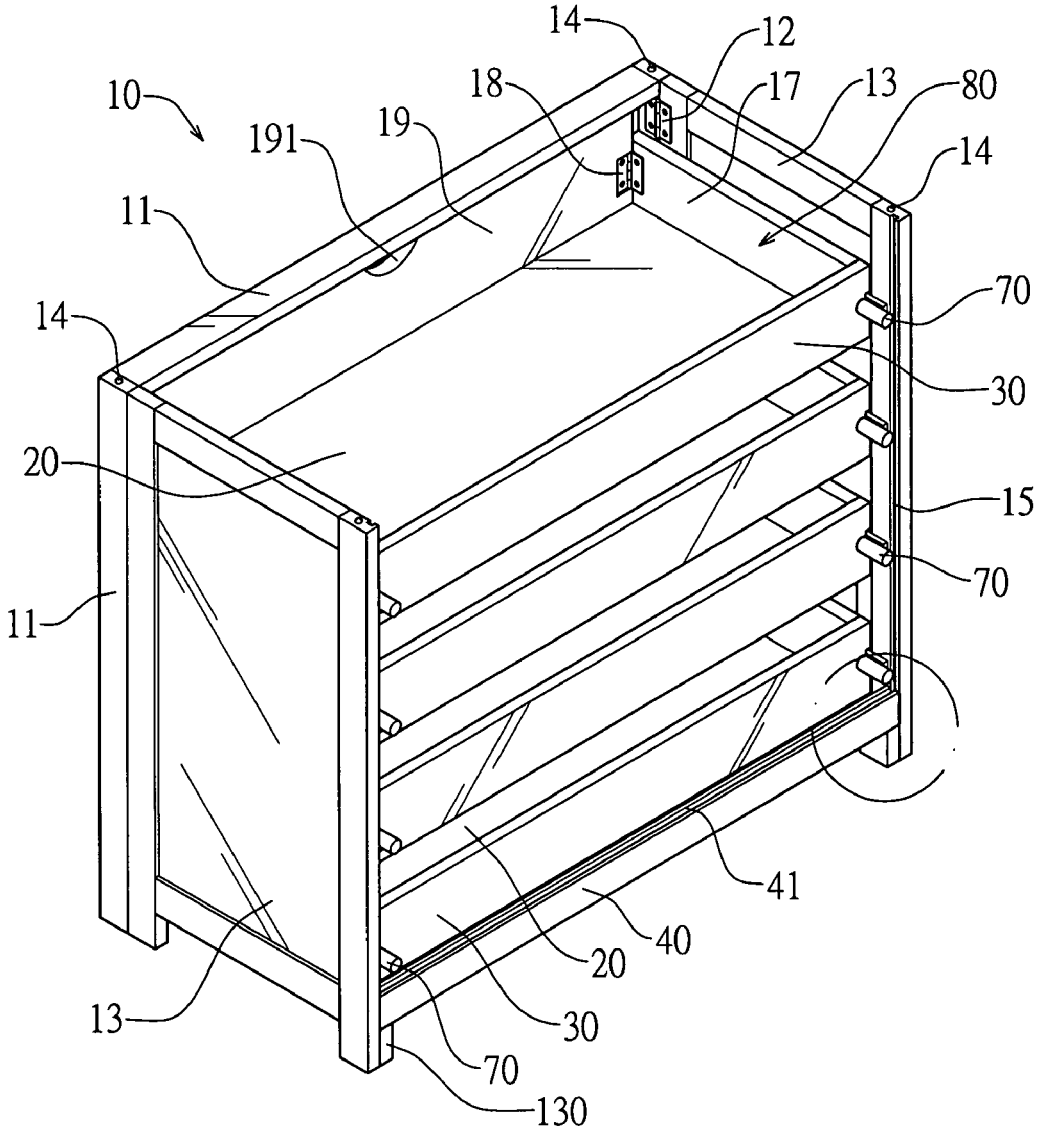
FIG. 9 is a partially perspective view of the combination cabinet as shown in FIG. 1.
Figure 10:
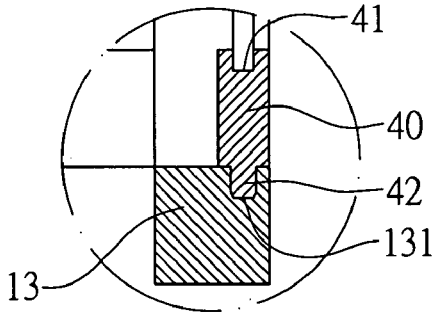
FIG. 10 is a locally enlarged cross-sectional view of the combination cabinet as shown in FIG. 9.

As shown in FIGS. 2, 9 and 10, the connecting seat 40 is rested on the support stud 130 of each of the side boards 13, and each of the limit stubs 42 of the connecting seat 40 is inserted into the limit hole 131 of the respective side board 13. Thus, the side boards 13 of the main body 10 are fixed by the connecting seat 40.

Figure 11:
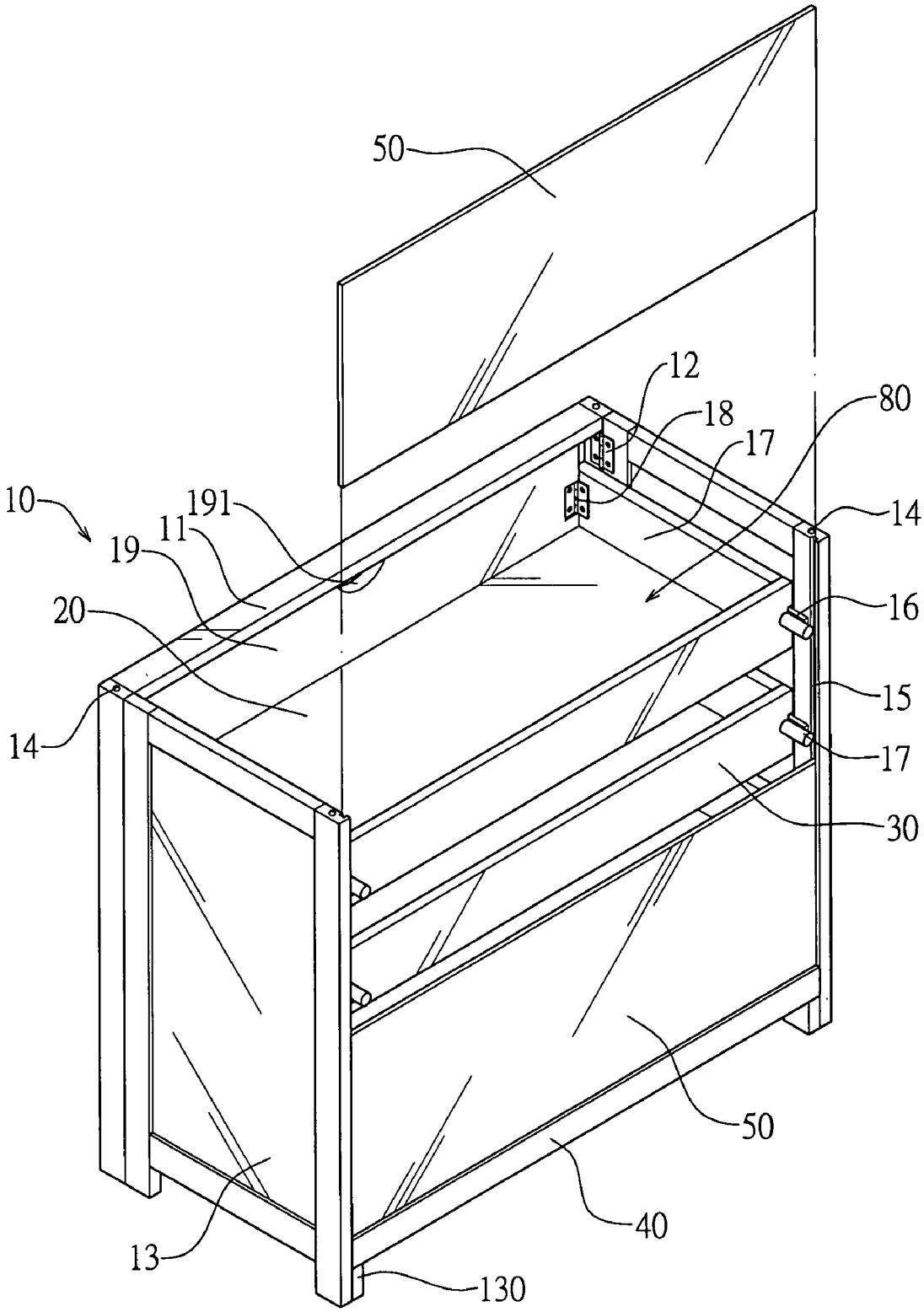
FIG. 11 is a partially perspective view of the combination cabinet as shown in FIG. 1.

As shown in FIGS. 2 and 11, each of the resting boards 50 is inserted into the guide channels 15 of the side boards 13, and the connecting seat 40 is rested on the lowermost one of the resting boards 50. At this time, the lowermost one of the resting boards 50 is inserted into the limit channel 41 of the connecting seat 40.

As shown in FIGS. 1 and 2, the top board 60 is mounted on the top of the main body 10 and rested on an uppermost one of the resting boards 50, thereby constructing the combination cabinet 1 as shown in FIG. 1. At this time, the positioning ribs 14 of the main body 10 are positioned in the positioning holes 61 of the top board 60, and the mounting holes 64 of the top board 60 are mounted on the side boards 13 of the main body 10.

Accordingly, the main body 10 is folded to have a flat shape and all parts of the combination cabinet 1 are folded and detached before assembly, so that the combination cabinet 1 has a smaller volume, thereby facilitating packaging, storage and transportation of the combination cabinet 1. In addition, the combination cabinet 1 is assembled and disassembled easily and quickly without needing aid of any hand tool, thereby facilitating a user assembling and disassembling the combination cabinet 1.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A combination cabinet, comprising a main body, a plurality of bottom boards, a plurality of back boards, a plurality of resting boards, a top board, and a connecting seat, wherein:

the main body includes a front frame, two side boards each having a first end pivotally mounted on one of two opposite ends of the front frame and each provided with a plurality of guide rails, a plurality of sliding boards each slidably mounted on a respective guide rail of each of the side boards, and a plurality of juxtaposed front boards each having two opposite ends each mounted on a first end of a respective sliding board to move with the respective sliding board;

each of the bottom boards is detachably mounted between a respective front board of the main body and two respective sliding boards of the main body;

each of the back boards has two opposite ends each mounted on a second end of a respective sliding board of the main body to move with the respective sliding board of the main body;

each of the resting boards has two opposite ends each detachably mounted on a second end of a respective side board of the main body;

the top board is mounted on a top of the main body;

the connecting seat is mounted on a bottom of the main body to support the resting boards;

each of the sliding boards of the main body is pivotally mounted on the respective front board by a hinge.

2. The combination cabinet in accordance with claim 1, wherein each of the side boards of the main body is pivotally mounted on the front frame by a plurality of hinges.

3. The combination cabinet in accordance with claim 1, wherein the second end of each of the side boards is formed with an axially extending elongated guide channel in which each of the resting boards is slidable.

4. The combination cabinet in accordance with claim 3, wherein the guide channel of each of the side boards has a lower end formed with a protruding support stud having a limit hole, and the connecting seat has a bottom rested on the support stud of each of the side boards and formed with two opposite limit stubs each inserted into the limit hole of the respective side board.

5. The combination cabinet in accordance with claim 1, wherein each of the sliding boards of the main body has a lower end formed with an axially extending elongated guide slot to allow insertion of a respective bottom board.

6. The combination cabinet in accordance with claim 1, wherein each of the front boards of the main body has a lower end formed with an axially extending elongated limit slot to allow insertion of a respective bottom board.

7. The combination cabinet in accordance with claim 1, wherein the main body further includes a plurality of positioning ribs mounted on a top of the front frame and a top of each of the side boards, and the top board has a bottom formed with a plurality of positioning holes to position the positioning ribs of the main body.

8. The combination cabinet in accordance with claim 1, wherein each of the back boards is rested on a respective bottom board so that each of the back boards, two respective sliding boards of the main body, a respective front board of the main body and a respective bottom board form a rectangular box which is covered by the top board.

9. The combination cabinet in accordance with claim 8, wherein the resting boards are located between the side boards of the main body and laminate each other so that the front frame of the main body, the side boards of the main body and the resting boards form a hollow rectangular structure to enclose the rectangular box.

10. The combination cabinet in accordance with claim 1, wherein each of the back boards has a lower end formed with an axially extending elongated retaining slot to allow insertion of a respective bottom board.

11. The combination cabinet in accordance with claim 1, wherein the connecting seat is rested on a lowermost one of the resting boards, and the top board is rested on an uppermost one of the resting boards so that the resting boards are limited between the top board and the connecting seat.

12. The combination cabinet in accordance with claim 1, wherein the connecting seat is located between the side boards of the main body and has two opposite ends each detachably mounted on the second end of a respective side board of the main body, and the top board has a periphery formed with a downward extending enclosure enclosed around the main body, and the enclosure of the top board has two opposite ends each formed with a mounting hole mounted on a respective side board of the main body.

13. The combination cabinet in accordance with claim 1, wherein each of the sliding boards of the main body has a side formed with an axially extending elongated slideway slidable on the respective guide rail of each of the side boards.

14. The combination cabinet in accordance with claim 1, wherein the connecting seat has an upper end formed with an axially extending elongated limit channel to allow insertion of the lowermost one of the resting boards.

15. The combination cabinet in accordance with claim 1, wherein the sliding boards of the main body are located in and encompassed by the side boards.

16. The combination cabinet in accordance with claim 1, wherein each of the front boards of the main body an upper end formed with an opening to facilitate a user holding each of the front boards of the main body.

17. A combination cabinet, comprising a main body, a plurality of bottom boards, a plurality of back boards, a plurality of resting boards, a top board, and a connecting seat, wherein:

the main body includes a front frame, two side boards each having a first end pivotally mounted on one of two opposite ends of the front frame and each provided with a plurality of guide rails, a plurality of sliding boards each slidably mounted on a respective guide rail of each of the side boards, and a plurality of juxtaposed front boards each having two opposite ends each mounted on a first end of a respective sliding board to move with the respective sliding board;

each of the bottom boards is detachably mounted between a respective front board of the main body and two respective sliding boards of the main body;

each of the back boards has two opposite ends each mounted on a second end of a respective sliding board of the main body to move with the respective sliding board of the main body;

each of the resting boards has two opposite ends each detachably mounted on a second end of a respective side board of the main body;

the top board is mounted on a top of the main body;

the connecting seat is mounted on a bottom of the main body to support the resting boards;

the second end of each of the sliding boards is formed with two spaced limit posts and a threaded rod located between the limit posts, and each of the two opposite ends of each of the back boards is formed with two spaced limit holes to allow insertion of the limit posts of the respective sliding board and a though hole located between the limit holes to allow insertion of the threaded rod of the respective sliding board.

18. The combination cabinet in accordance with claim 17, wherein each of the back boards is mounted on the respective sliding boards of the main body by two fixing rods, the threaded rod of each of the sliding boards extends through and partially protrudes from the through hole of the respective back board, and each of the fixing rods is rested on the respective back board and has an inside formed with a screw hole screwed onto the threaded rod of the respective sliding board.

19. A combination cabinet, comprising a main body, a plurality of bottom boards, a plurality of back boards, a plurality of resting boards, a top board, and a connecting seat, wherein:

the main body includes a front frame, two side boards each having a first end pivotally mounted on one of two opposite ends of the front frame and each provided with a plurality of guide rails, a plurality of sliding boards each slidably mounted on a respective guide rail of each of the side boards, and a plurality of juxtaposed front boards each having two opposite ends each mounted on a first end of a respective sliding board to move with the respective sliding board;

each of the bottom boards is detachably mounted between a respective front board of the main body and two respective sliding boards of the main body:

each of the back boards has two opposite ends each mounted on a second end of a respective sliding board of the main body to move with the respective sliding board of the main body;

each of the resting boards has two opposite ends each detachably mounted on a second end of a respective side board of the main body;

the top board is mounted on a top of the main body;

the connecting seat is mounted on a bottom of the main body to support the resting boards;

each of the two opposite ends of each of the back boards has an end face formed with a slideway slidable on the respective guide rail of each of the side boards.

* * * * *